US010889983B2

(12) United States Patent
Hon

(10) Patent No.: US 10,889,983 B2
(45) **Date of Patent: *Jan. 12, 2021**

(54) RECYCLABLE BUILIDNG BLOCK AND BUILDING SYSTEM USED FOR CONSTRUCTING BUILDING

(71) Applicant: SHENZHEN NEW TENON CO., LTD., Shenzhen (CN)

(72) Inventor: Man Ching Hon, Shenzhen (CN)

(73) Assignee: SHENZHEN NEW TENON CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/699,714

(22) Filed: Dec. 1, 2019

(65) Prior Publication Data

US 2020/0102738 A1 Apr. 2, 2020

Related U.S. Application Data

(63) Continuation-in-part of application No. 15/964,053, filed on Apr. 26, 2018, now Pat. No. 10,526,783.

(51) Int. Cl.
*E04B 2/18* (2006.01)
*E04B 2/02* (2006.01)

(52) U.S. Cl.
CPC ..... *E04B 2/18* (2013.01); *E04B 2002/0204* (2013.01); *E04B 2002/0247* (2013.01)

(58) Field of Classification Search
CPC ..... E04B 2/18; E04B 2/20; E04B 2/08; E04B 2/10; E04B 2002/0208; E04B 2002/0215; E04B 2002/0219; E04B 2002/0226; E04B 2002/0228; E04B 2002/0232; E04B 2002/0247; E04B 2002/0234; E04C 1/397; A63H 33/08; A63H 33/086; A63H 33/082; A63H 33/044
USPC ..... 52/286, 503, 504, 505, 561, 562, 563, 52/564, 565, 566, 569, 570, 571, 572, 52/596, 603, 605; 446/127, 124, 125, 446/126
See application file for complete search history.

(56) References Cited

U.S. PATENT DOCUMENTS 112,925 A * 3/1871 Johnson ..... E04B 2/42 52/505
676,803 A * 6/1901 Shaw ..... E04B 2/08 52/590.1

(Continued)

FOREIGN PATENT DOCUMENTS

GB 2411412 B * 6/2009 ..... E04B 2/06

*Primary Examiner* — Kyle J. Walraed-Sullivan

(57) ABSTRACT

A building system used for constructing a building is disclosed in the present invention. The building system includes: a first block, a corner block and a connection block interlocking with each other for constructing the building; wherein, dimensional relations between the first block, the corner block and the connection block satisfying the following conditions: Lco=L+W; Wco=½L+W; Lci=L; Wci=½L; Lcb=½L; Wcb=W; Wherein, is a length of the first block; W is a width of the first block; Lco is an outer length of the corner block; Wco is an outer width of the corner block; Lci is an inner length of the corner block; Wci is an inner width of the corner block; Lcb is a length of the connection block; Wcb is a width of the connection block.

15 Claims, 15 Drawing Sheets

(56) References Cited

U.S. PATENT DOCUMENTS 1,459,189 A * 6/1923 Swanson ..... E04B 2/04 52/586.1
1,566,228 A * 12/1925 Ryan ..... E04B 2/42 52/286
2,201,110 A * 5/1940 Makram ..... E04B 2/08 52/566
2,688,245 A * 9/1954 Vesper ..... E04B 2/18 52/592.5
3,033,598 A * 5/1962 Polgar ..... F16B 12/00 403/178
3,936,987 A * 2/1976 Calvin ..... E04B 2/08 52/309.1
3,999,350 A * 12/1976 MacKenzie ..... A47B 96/1408 52/633
4,041,670 A * 8/1977 Kaplan ..... E04B 2/18 52/592.2
4,107,894 A * 8/1978 Mullins ..... E04B 2/18 52/592.6
4,262,463 A * 4/1981 Hapel ..... E04B 2/18 52/98
4,314,431 A * 2/1982 Rabassa ..... E04B 2/46 52/259
4,671,039 A * 6/1987 Hunt ..... E04B 2/18 52/562
4,896,999 A * 1/1990 Ruckstuhl ..... E04C 1/395 405/286
5,181,362 A * 1/1993 Benitez ..... E04B 2/18 52/578
5,457,926 A * 10/1995 Jensen ..... E04B 2/18 52/309.4
5,715,635 A * 2/1998 Sherwood ..... E04B 2/16 52/286
5,775,046 A * 7/1998 Fanger ..... A47B 81/06 108/157.16
5,934,037 A * 8/1999 Bundra ..... E04B 2/08 52/126.4
6,035,599 A * 3/2000 Sonnentag ..... E02D 29/025 52/105
6,053,661 A * 4/2000 Lewis ..... E02B 11/00 405/258.1
6,122,881 A * 9/2000 Aubertot ..... E04B 2/14 52/596
6,244,009 B1 * 6/2001 Cerrato ..... E04B 2/08 52/223.7
7,037,047 B1 * 5/2006 Tufts ..... E02D 29/025 405/284
7,108,577 B2 * 9/2006 Peters ..... A63H 33/084 446/124
7,305,803 B2 * 12/2007 Correa ..... E04B 2/16 52/503
7,823,858 B2 * 11/2010 Matsufuji ..... B28B 7/183 249/149
7,833,077 B1 * 11/2010 Simmons, Jr. ..... A63H 33/08 446/127
8,187,050 B1 * 5/2012 Sorensen ..... A63H 33/084 446/120
D662,225 S * 6/2012 Amidon ..... D25/113
8,469,321 B2 * 6/2013 Nolfi, Jr. ..... E04C 1/397 248/68.1
D686,756 S * 7/2013 Nanayakkara ..... D25/113
D763,365 S * 8/2016 Timg ..... D21/501
2002/0007610 A1 * 1/2002 Abang Ali ..... E04B 2/44 52/604
2002/0043038 A1 * 4/2002 Cerrato ..... E04B 1/703 52/604
2004/0102132 A1 * 5/2004 Miller ..... A63H 33/082 446/125
2004/0121699 A1 * 6/2004 Ladner ..... A63H 33/082 446/85
2005/0005556 A1 * 1/2005 Collier ..... E04B 2/18 52/578
2006/0000179 A1 * 1/2006 Albert ..... E04B 2/16 52/606
2007/0006542 A1 * 1/2007 Duke ..... E04B 2/06 52/561
2007/0094989 A1 * 5/2007 Scheker ..... E04C 1/397 52/596
2007/0245673 A1 * 10/2007 Cerrato ..... E04B 2/18 52/607
2009/0313923 A1 * 12/2009 Bucheger ..... E04B 2/44 52/223.7
2010/0043335 A1 * 2/2010 O'Connor ..... E04B 2/16 52/592.6
2010/0223876 A1 * 9/2010 Jones ..... E04B 2/08 52/588.1
2010/0282060 A1 * 11/2010 Duke ..... E04B 2/08 89/36.02
2012/0090260 A1 * 4/2012 Muirhead ..... E04B 2/20 52/585.1
2013/0042559 A1 * 2/2013 Weber ..... E04B 2/44 52/439
2013/0152489 A1 * 6/2013 Weber ..... E04B 2/48 52/126.4
2013/0276401 A1 * 10/2013 MacDonald ..... E02D 29/025 52/606
2013/0333313 A1 * 12/2013 Alsayed ..... E04B 2/54 52/220.1
2014/0059965 A1 * 3/2014 Edwards ..... E04B 2/16 52/588.1
2014/0202111 A1 * 7/2014 Drew ..... E04B 2/16 52/589.1
2014/0223848 A1 * 8/2014 Binhussain ..... E04B 2/18 52/309.17
2014/0260029 A1 * 9/2014 Browning ..... E04C 1/41 52/309.4
2016/0090705 A1 * 3/2016 Scherkl ..... E02B 3/14 405/114
2016/0108614 A1 * 4/2016 Munz ..... E04B 1/04 52/604
2016/0123004 A1 * 5/2016 Lightfoot ..... E04B 2/84 52/286
2017/0145690 A1 * 5/2017 Genest ..... E04B 2/46

* cited by examiner

RECYCLABLE BUILIDNG BLOCK AND BUILDING SYSTEM USED FOR CONSTRUCTING BUILDING

CROSS REFERENCE TO RELATED APPLICATION

This application is a continuation-in-part of U.S. Ser. No. 15/964,053, filed on Apr. 26, 2018, pending, and entitled "RECYCLABLE BUILDING BLOCK AND BUILDING SYSTEM USED FOR CONSTRUCTING BUILDING", which is a continuation-in-part of International Application No. PCT/CN2017/000151, filed Feb. 10, 2017 designating the United States and claiming priority with respect to Chinese Patent Application No. 201610098785.X, filed Feb. 17, 2016, entitled "ENVIRONMENTALLY FRIENDLY BUILDING KIT", the disclosures of both foregoing applications being incorporated herein by reference.

TECHNICAL FIELD

The present disclosure relates to building material, and more particularly to a recyclable building system used for constructing a building.

BACKGROUND ART

Generally, a solid waste involved in the present disclosure includes: industrial solid wastes, domestic wastes, construction wastes, urban sludge, and crop straw wastes. The industrial wastes include, but not limited to, a waste slag, a slag and corner wastes of industrial products. The domestic wastes include, but not limited to, waste papers, waste furniture, used plastic, packaging materials and surplus deteriorating foods, which are produced in daily life. The construction wastes include, but not limited to, cement blocks, bricks and decorative materials produced while old buildings are demolished. The urban sludge includes, but not limited to, sludge produced by sewage treatment, sludge excavated in urban underground projects, and sludge deposited in urban sewage all year round. The crop straw wastes include, but not limited to, rice straw, wheat straw, corn stalk, sorghum stalk, cotton straw, peanut straw, sesame straw, and rape straw. At present, there are many methods to deal with these various types of wastes. However, with the continuous development of the society, the various types of wastes have not been handled well and become increasingly serious social problems and continue to cause harm to the human living environment.

At the same time, various methods for constructing walls are using cement mortar to block bricks into walls, or after the frame structure is built, the wall plates are fixed to the frame structure. These methods must be implemented by professional staff using professional tools and equipment. And the built walls are all base blank walls without any decorative. After the wall is built, if it needs to be renovated and decorated, the building material used for building the wall cannot be used repeatedly for construction and demolition. As a result, a large amount of building materials is wasted, and the disassembled construction waste cannot be decomposed and become new solid wastes, causing environmental pollution.

Therefore, a new recyclable building system needs to be provided.

BRIEF DESCRIPTION OF THE DRAWINGS

The above and/or additional objects, features and advantages of the present disclosure, will be further elucidated by the following illustrative and non-limiting detailed description of embodiment of the present disclosure, with reference to the appended drawings, wherein.

DESCRIPTION OF THE PREFERRED EMBODIMENTS

Figure 1:
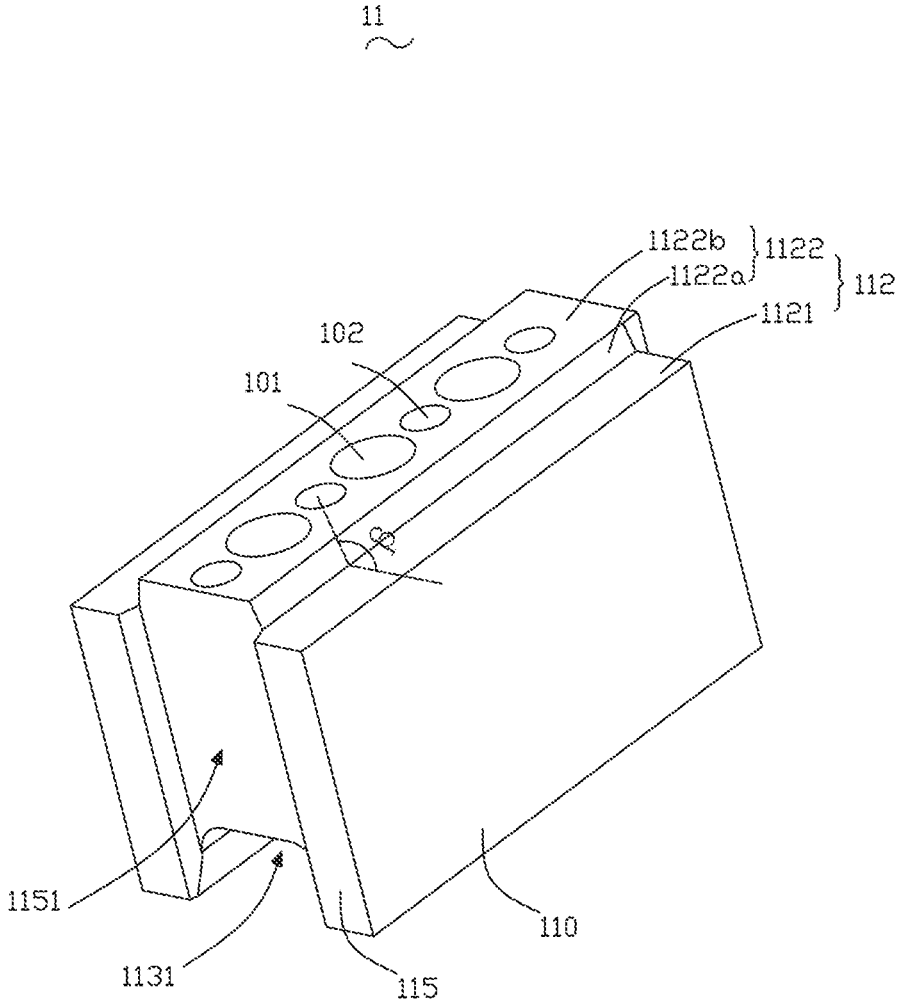
FIG. 1 illustrates an upper isometric view of a building block of a building system according to a first embodiment of the present disclosure, wherein the building block is designed as a first block.
Figure 2:
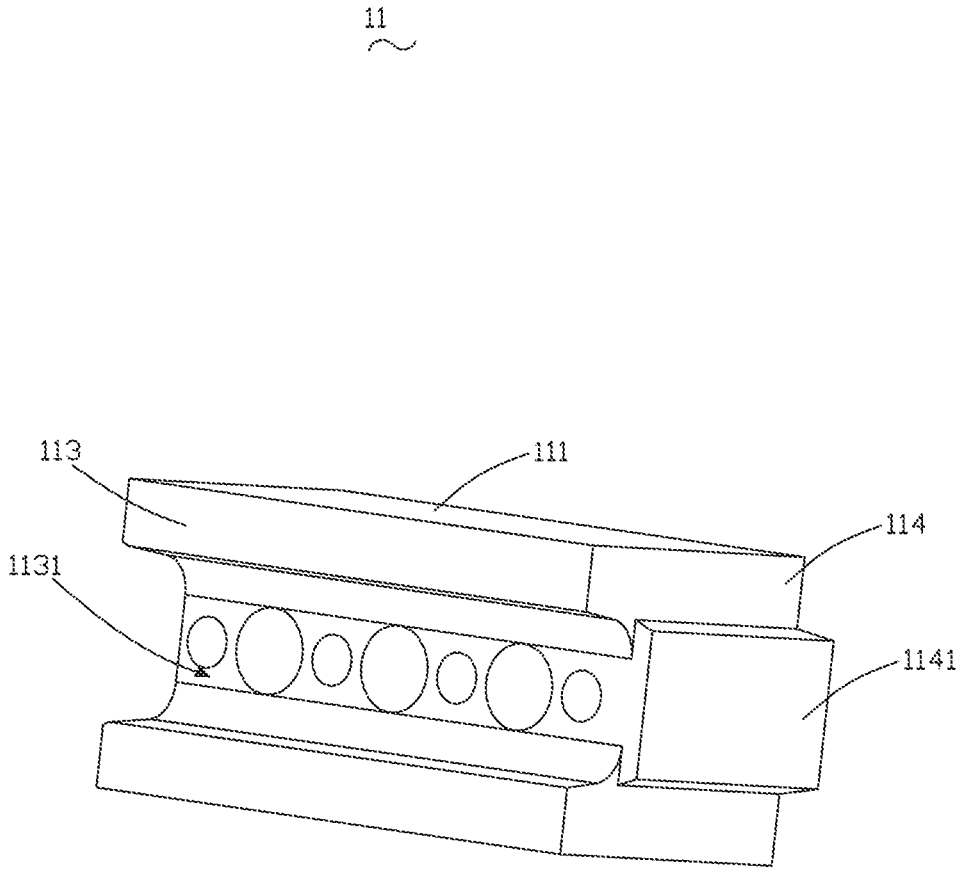
FIG. 2 illustrates a lower isometric view of the building block shown in FIG. 1.
Figure 3:
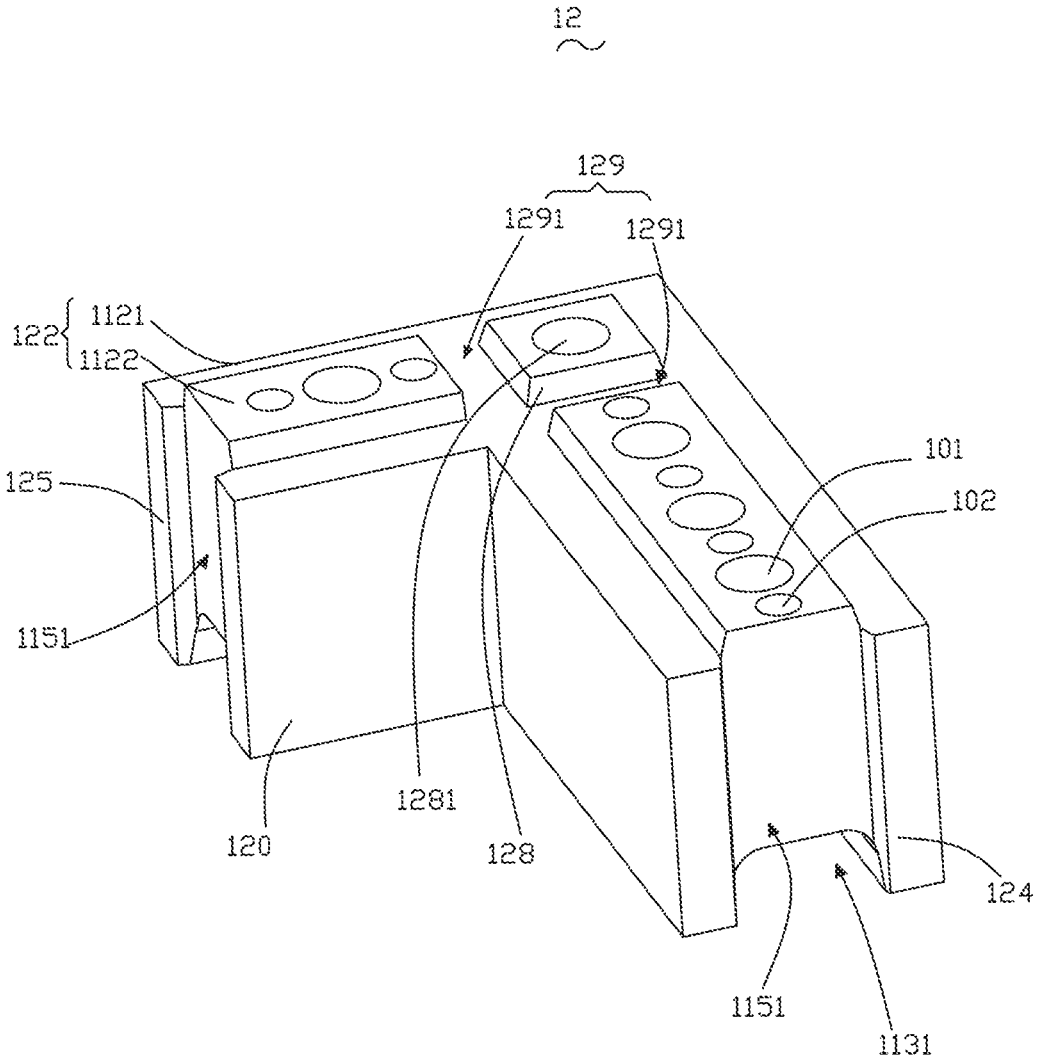
FIGS. 3-4 illustrate isometric views of another building block of the building system according to the first embodiment of the present disclosure, wherein such building block is designed as a corner block.

The present invention will be further illustrated below with reference to the attached drawings and the embodiments. The description in more detail aims to help to understand the present invention, instead of limiting the present invention. According to the contents disclosed by the present invention, those skilled in the art shall understand that the present invention can be implemented even without some or all of these specific details. Under other circumstances, to avoid weakening the inventiveness of the present invention, the well-known methods, structures and the like will not be described in detail.

Certain terminology is used in the following description for convenience only and is not intended to be limiting. For purposes of this description, the terms "vertical" and "horizontal" are merely illustrative of relative space positions of the various components in the drawings. In actual practice, it is apparent that the components can be aligned in either orientation. Moreover, the terms "upper", "lower", "upward", "outward", "inward", "inner" and "outer" designate directions in the drawing to which reference is made. Such terminology includes the terms above specifically mentioned and words of similar import.

Figure 15:
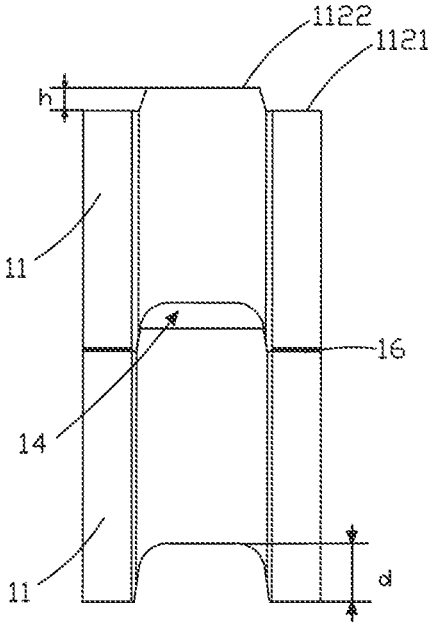
FIG. 15 further shows two building blocks of the building system according to the first embodiment of the present disclosure interlocking with each other, and a horizontal through hole thus formed therebetween.
Figure 16:
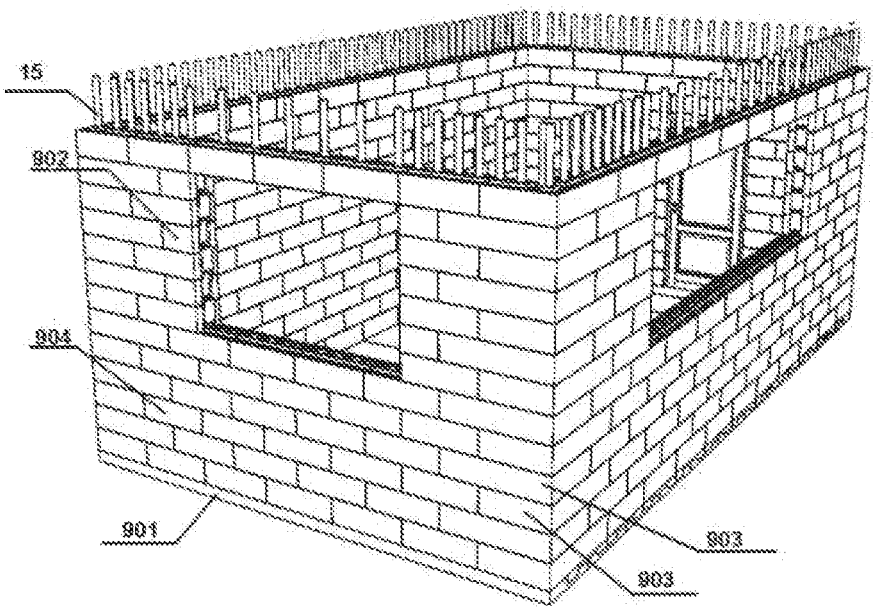
FIG. 16 illustrates a perspective view of a building constructed using the building system.
Figure 17:
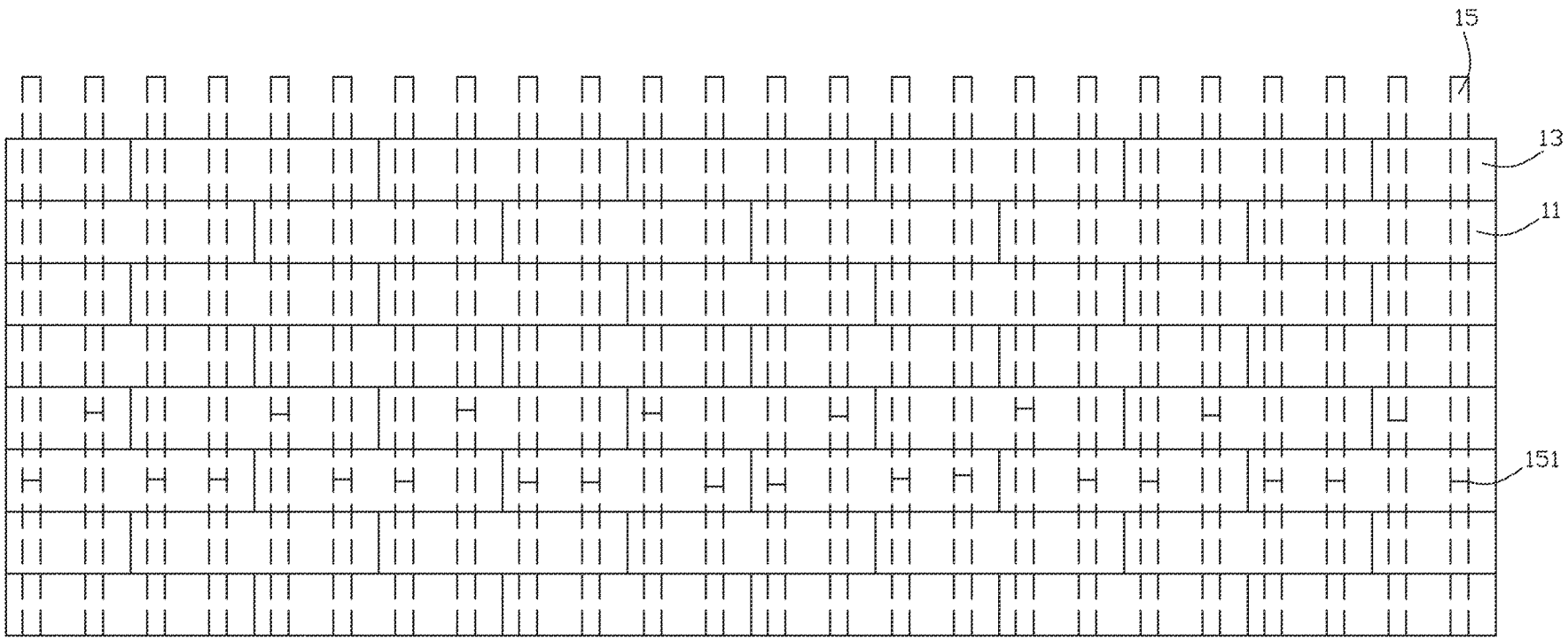
FIG. 17 shows a plurality of reinforcing elements inserted into the building wall while a plurality of similar building blocks interlocking with each other to form such building wall.

As shown in FIG. 1 through FIG. 7, as well as FIGS. 15-17, a building system 1 according to a first embodiment of the present disclosure is used for constructing a building 900. The building system 1 including a plurality of building blocks is mounted on a flat foundation 901 to construct the building 900. The building system 1 includes a first block 11 used at a first position 904 while constructing the building 900, a corner block 12 used at a corner position 903 while constructing the building 900, and a connection block 13 used to fill the gaps 902 created while constructing the building 900, such as one or two points of a termination. The first block 11, corner block 12 and the connection block 13 may interlock with each other to construct the building 900.

The first block 11 is substantially cuboid-shaped block structure for constructing the building 900. The first block 11 includes an inner face 110, an outer face 111 opposite to the inner face 110, an upper face 112, a lower face 113 opposite to the upper face 112, a first end 114 and a second end 115 opposite to the first end 114. The inner face 110 and outer face 111 are substantially planar faces. The outer face 111 and inner face 110 may be a smooth face or a patterned face. At least one of the outer face 111 and the inner face 110 may be decorated as desired. Alternatively, the building block 11 may include a decorative face attached to at least one of the inner face 110 and the outer face 111. The decorative face can be decorated with multiple colors or colored patterns by means of printing, molding, filming, engraving, pasting or hand-painting. The pattern may be flat or three-dimensional wood grain, stone grain, brick grain, skin grain. The pattern may be people, photos, geometry, logo and so on. Alternatively, the decorative face may be integrally formed with at least one of the outer face and inner face.

The upper face 112 has a base face 1121 and a projection 1122 protruding upwards from the base face 1121. The projection 1122 is disposed at a center of the upper face 112 and extending longitudinally for the entire length of the upper face 112. The projection 1122 is generally trapezoidal shaped in cross sectional configuration. Specifically, the projection 1122 has a pair of guiding faces 1122*a* opposite to each other and a top face 1122*b* connected between the guiding faces 1122*a*. Each of the guiding faces 1122*a* extends inclined from the base face 1121 for preventing water from flowing into the building block, i.e. the guiding face 1122*a* of the projection 1122 is connected with the base face 1121 of the upper face 112 at an angle β The angle β may be greater than 90 degrees and smaller than 180 degrees. With the configuration of the guiding face 1122*a*, the blocks stacked upon each other can be well positioned and guided to interlock with each other.

The lower face 113 is substantially complementary to the upper face 112. Specifically, the lower face 113 has a complementary groove 1131 for receiving the projection 1122 of a cooperating block when the blocks stacked upon each other to form an interlocking bond, wherein the cooperating block is similar to the first block 11. In the present disclosure, a depth d of the groove 1131 is greater than a height h of the projection 1122 in a vertical direction Z so that a horizontal through hole 14 is formed by the projection 1122 of one first block 11 mating with the groove 1131 of the cooperating block when the blocks stacked upon each other, wherein the cooperating block is identical or similar to the first block 11. The horizontal through hole 14 may be used for receiving electrical wires, pipes or other utility.

The first block 11 further includes a plurality of first through holes 101 disposed in the projection 1122 and extending from the top face 1122*b* of the projection 1122 to the lower face 113 of the building block 11. The plurality of first through holes 101 are arranged spaced-apart with each other at an equal interval. The first through hole 101 may be cuboidal shaped, cylindrical-shaped, and the like. The design of a plurality of first through holes 101 facilitates in the formation of a first vertical channel, when a plurality of blocks, similar to first block 11, are stacked upon each other.

The first block 11 further includes a plurality of third through holes 102 disposed in the projection 1122 and extending from the top face 1122*b* of the projection 1122 to the lower face 113 of the building block 11 for receiving electrical wires, pipes or other utility. The plurality of third through holes 102 are arranged spaced-apart with each other at an equal interval. Each third through hole 102 is located between two adjacent first through holes 101. The third through hole 102 may be cuboid shaped, cylindrical-shaped, and the like. A diameter of the third through hole 102 is smaller than that of the first through hole 101. Alternatively, the diameter of the third through hole 102 may be equal to the first through hole 101.

The first end 114 has a tongue 1141 formed at a center thereof. The tongue 1141 protrudes outward at the first end 114 of the first block 11, i.e. protrudes in a direction away from the second end 115. The tongue 1141 extends longitudinally for the entire length of the first end 114. The entire length of the first end 114 is a length of the first block 11 in a vertical direction Z. The second end 115 has a concave portion 1151 formed at a center thereof. The concave portion 1151 protrudes inward at the second end 115, i.e. protrudes in a direction toward the first end 114. The concave portion 1151 extends longitudinally for the entire length of the second end 115. The entire length of the first end 115 is the length of the first block 11 in the vertical direction Z. The configuration of the tongue 1141 and the concave portion 1151 is produced such that the tongue of one first block can interlock with the concave portion of a cooperating block, wherein the cooperating block is identical or similar to the first block 11.

Figure 4:
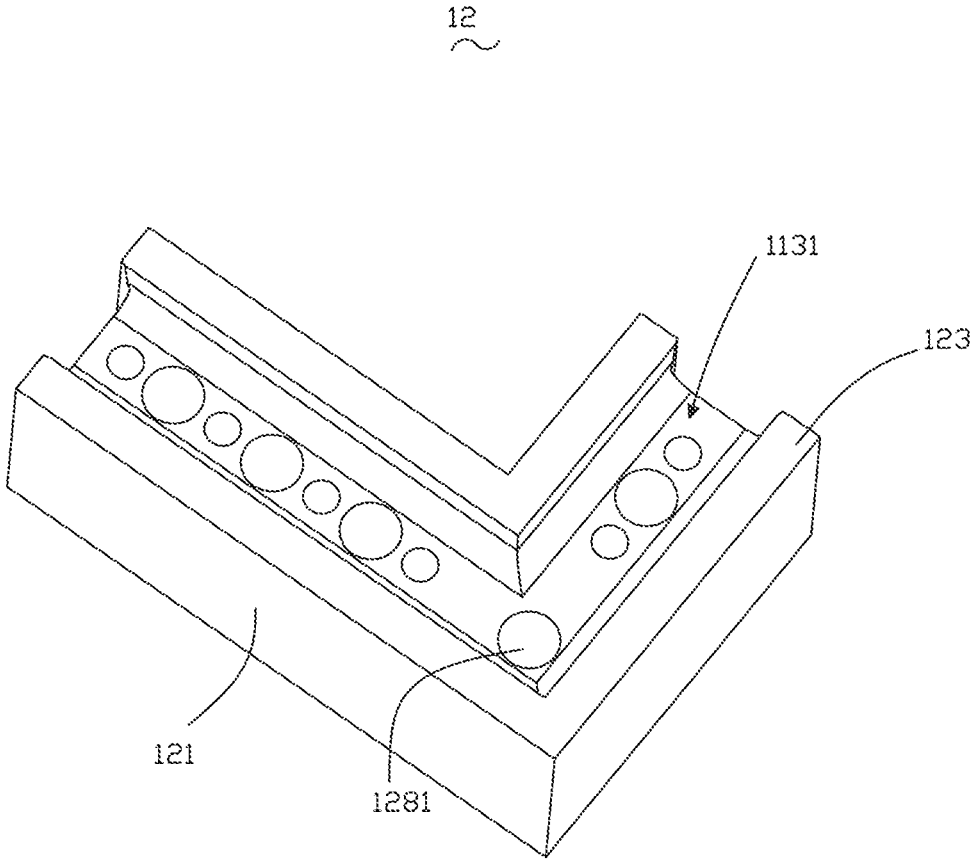
Figure 5:
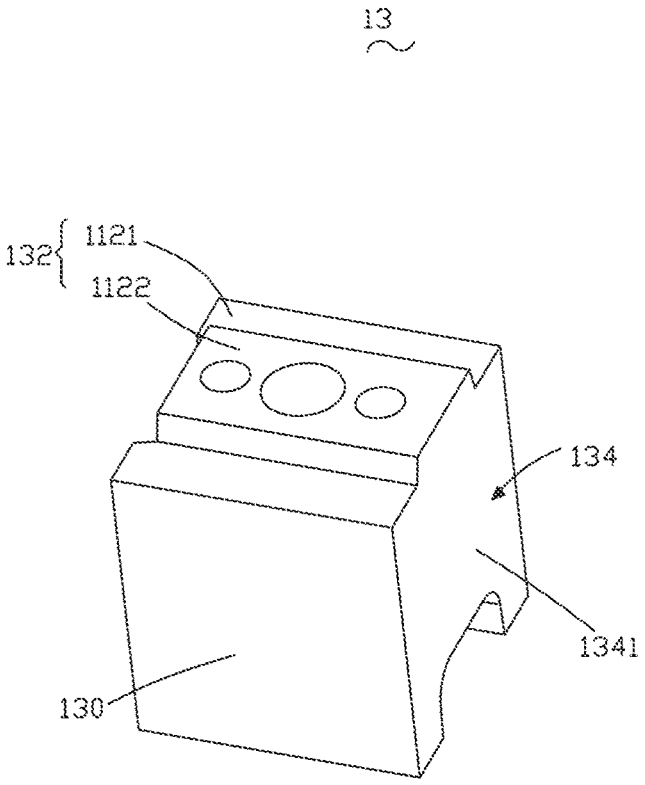
FIGS. 5-6 illustrate isometric views of the other building block of the building system according to the first embodiment of the present disclosure, wherein such building block is designed as a connection block.

The corner block 12 has a generally L-shaped outline when viewed from above in FIG. 4. The corner block 12 includes an inner face 120, an outer face 121 opposite to the inner face 120, an upper face 122, a lower face 123 opposite to the upper face 122, a first end 124 and a second end 125. The first end 124 is at right angles to the second end 125. The structure of the corner block 12 is substantially similar to that of the first block 11. The upper face 122 also has the base face 1121 and the projection 1122 extending for the entire length of the upper face 122 of the corner block 12. The lower face 123 also has the groove 1131. The corner block 12 also has the first through holes 101 and the third through holes 102 formed in the projection 1122 and extending from the top face 1122*b* of the projection 1122 to the lower face 123 of the corner block 12.

The first end 124 and the second end 125 both have the concave portions 1151, i.e. the concave portions 1151 protrudes inward at the first and second ends 124, 125, respectively. When a first block 11 and a corner block 12 are mated adjacent to each other, the interlocking bond is formed. Precisely, when the tongue 1141 of the first block 11 is mated with the concave portion 1151 of the corner block 12, the interlocking bond is formed due to the complementary nature of the structure between the tongue and the concave portion 1151.

The corner block 12 further includes an avoiding space 129 formed at the corner thereof. The avoiding space 129 is a recess formed by means of removing the projection 1122 at the corner. The avoiding space 129 includes two avoiding notches 1291. The corner block 12 further includes a protruding portion 128 disposed between two avoiding notches 1291 and protruding upwards from the base face 1121 of the upper face 112 of the corner block 12. The avoiding space 129 is configured for receiving the lower face 123 of cooperating corner block 12 when the corner blocks 12 stacked upon each other, wherein the cooperation corner block 12 is identical to the corner block 12. A second through holes 1281 is formed in the protruding portion 128 and extending from the protruding portion 128 to the lower face 123 of the corner block 12.

Figure 6:
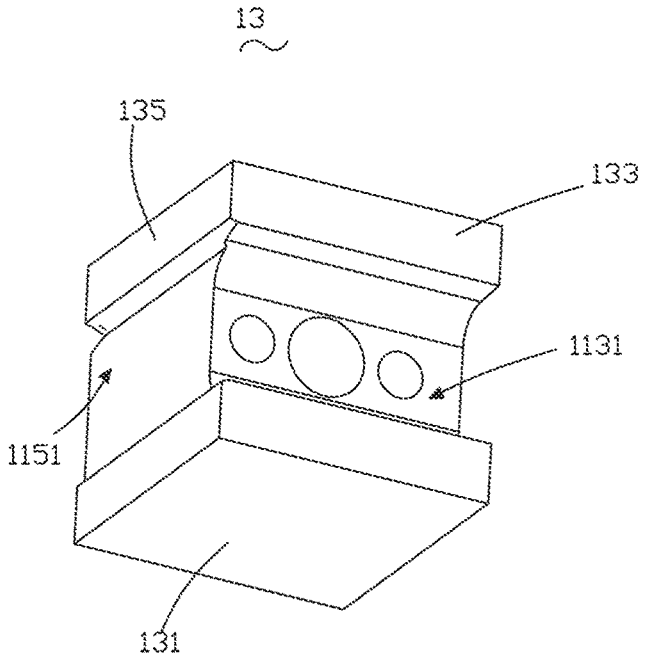
Figure 7A:
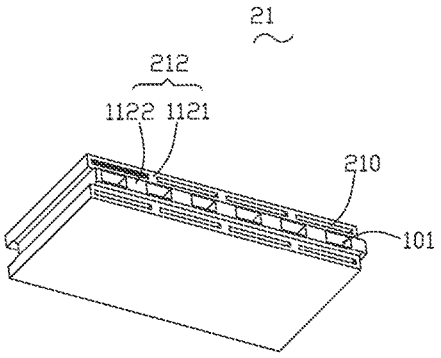
FIGS. 7*a*-7*b* illustrate isometric views of a building block of the building system according to a second embodiment of the present disclosure, wherein such building block is designed as the first block.
Figure 7B:
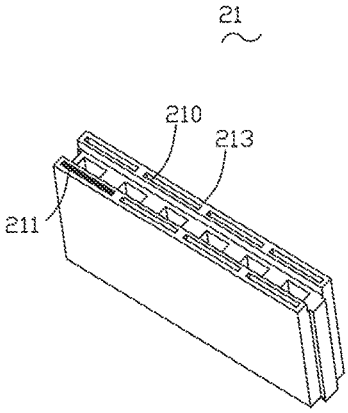
Figure 8A:
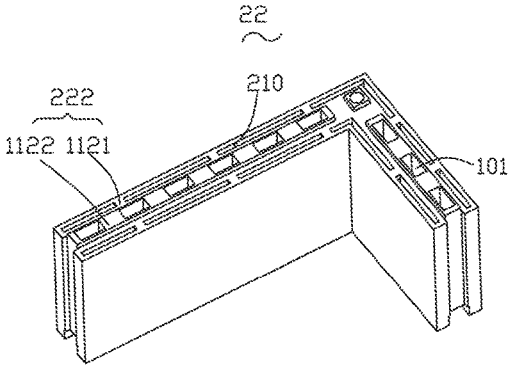
FIGS. 8*a*-8*b* illustrate isometric views of another building block of the building system according to the second embodiment of the present disclosure, wherein such building block is designed as the corner block.
Figure 8B:
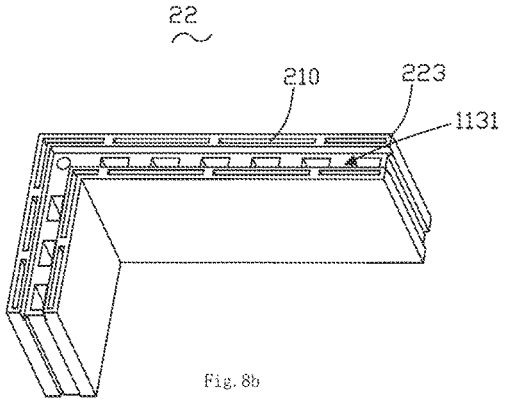
Figure 9A:
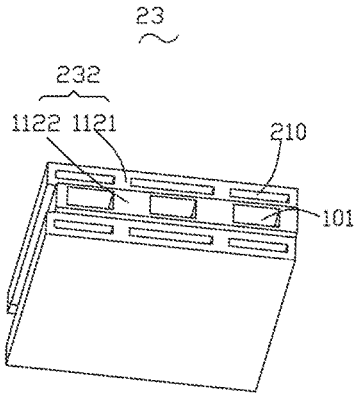
FIGS. 9*a*-9*b* illustrate isometric views of the other building block of the building system according to the second embodiment of the present disclosure, wherein such building block is designed as the corner block.
Figure 9B:
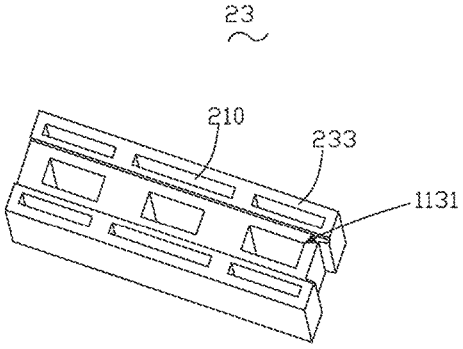
Figure 10:
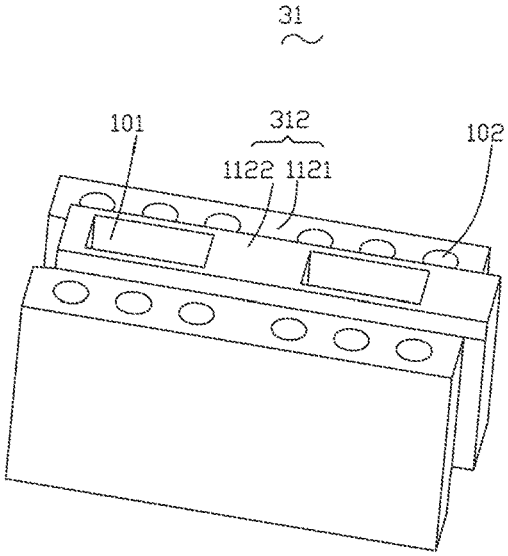
FIG. 10 illustrates isometric view of a building block of the building system according to a third embodiment of the present disclosure, wherein such building block is designed as the first block.

As shown in FIG. 6-7, the connection block 13 has one first through hole 101, however, the first block 11 has two first through holes 101. The connection block 13 also has an inner face 130, an outer face 131 opposite to the inner face 130, an upper face 132, a lower face 133 opposite to the upper face 132, a first end 134 and a second end 135 opposite to the first end 134. The upper face 132 also has the base face 1121 and the projection 1122. The lower face 123 also has the groove 1131. The connection block 13 also has the first through holes 101 and the third through holes 102 formed in the projection 1122 and extending from the top face 1122*b* to the lower face 133 of the connection block 13.

The first end 134 is a planar face 1341, and the second end 135 is the concave portion 1151, i.e. the concave portion 1151 protrudes inward at the second end 135. When a first block 11 and a connection block 13 are mated adjacent to each other, the interlocking bond is formed. Precisely, when the tongue 1141 of the first block 11 is mated with the concave portion 1151 of the connection block 13, the interlocking bond is formed due to the complementary nature of the structure between the tongue and the concave portion. The one or more connection blocks 13 are used to fill small uneven gaps created at the one or more points of termination while constructing the building 900.

The building system 1 further includes a reinforcing element 15 inserted into the first vertical channel formed by the first through holes 101 aligned with each other while a plurality of similar blocks stacked upon each other so that a more secure interlocking interconnection is exhibited. The reinforcing element 15 may be tubular-shaped, and made by hollow metal, plastic or composite material. With such configuration, the reinforcing element 15 may be used as a water supply pipe, a gas supply pipe, a power cable pipe, a communication cable pipe, and so on. The reinforcing element 15 may be shaped to match the first through hole 101, such as a reinforcing rod, which has a diameter smaller than that of the first through hole 101 by 1-2 mm. The reinforcing element 15 is detachable inserted into the vertical channel and can be removed when demolishing the building 900. Thus, the blocks can also be removed with no damage from the building and can be historically reused repeatedly as a new product. As shown in FIG. 17, a plurality of reinforcing elements is used for constructing the building wall. When the building wall is too high, at least two reinforcing elements 15 need to be connected together to be filled into the vertical channel. A connector 151 is used for connecting between at least two reinforcing elements 15, furtherly, the connector 151 is detachably connected between the reinforcing elements 15 so that the reinforcing elements 15 can be detachable while demolishing such building. The connector 151 in different vertical channel are not aligned with each other and are staggered with each other to make the building more firmly.

Preferably, a waterproof glue, a fastening glue, a structural glue, a cement or other adhesive may be applied between each of the interlocking blocks 11,12,13 to enhance the strength of the wall of the building.

The building system 1 further includes a plurality of sealing gaskets 16, each of the sealing gaskets 16 is sandwiched between two interlocking blocks, each of the two blocks may be at least one of the corner block 12, first block 11 and the connection block 13. When the block is stacked upon the cooperating block for constructing the building wall, the sealing gasket 16 is sandwiched between the blocks. The sealing gasket 16 is disposed on the base face 1121 of the upper face 112, 122, or 132 of the block and pressed by the lower face 113, 123 or 133 of the block. With such configuration, the building wall may be waterproof, soundproof, and insulate.

Alternatively, referring to FIGS. 8*a*-10*b*, according to a second embodiment of present disclosure, the differences between the first embodiment and the second embodiment are that the second through holes are omitted and a plurality of filling holes are formed in the first block 21, corner block 22 and connection block 23. Specifically, the first block 21 further includes at least one filling hole 210 disposed at the side of the projection 1122 and extending from the base face 1121 of the upper face 112 to the lower face 213 of the first block 21 for accommodating insulating material 211. The filling hole 210 may be cuboidal shaped. The first block 21 may include a plurality of filling holes 210 spaced apart each other at an equal interval and located at both sides of the projection 1122. When the first through hole 101 is cuboid shaped, the length of the filling hole 210 in the horizontal direction is greater than that of the first through hole 101.

Similarly, the corner block 22 also has the filling holes 210 disposed at the side of the projection 1122 and extending from the base face 1121 of the upper face 222 to the lower face 223 of the corner block 22 for accommodating insulating material 211. The corner block 22 may include a plurality of filling holes 210 spaced apart each other at an equal interval and located at both sides of the projection 1122. When the first through hole 101 is cuboid shaped, the length of the filling hole 210 in the horizontal direction is greater than that of the first through hole 101.

Similarly, the connection block 23 also has the filling holes 210 disposed at the side of the projection 1122 and extending from the base face 1121 of the upper face 232 to the lower face 233 of the connection block 23 for accommodating insulating material 211. The connection block 23 may include a plurality of filling holes 210 spaced apart each other at an equal interval and located at both sides of the projection 1122. When the first through hole 101 is cuboid shaped, the length of the filling hole 210 in the horizontal direction is greater than that of the first through hole 101.

Figure 11:
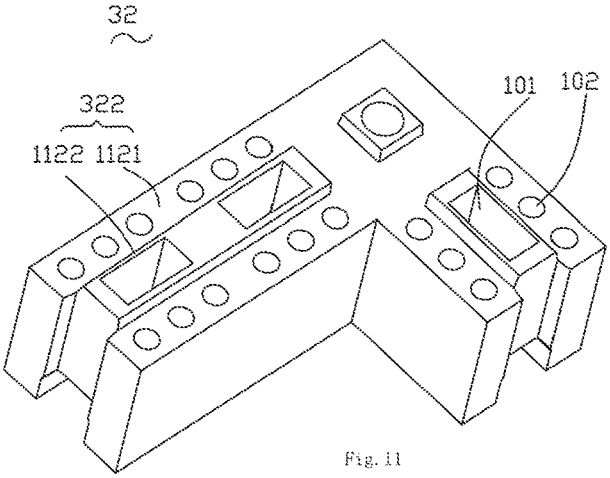
FIG. 11 illustrates isometric view of another building block of the building system according to the third embodiment of the present disclosure, wherein such building block is designed as the corner block.
Figure 12:
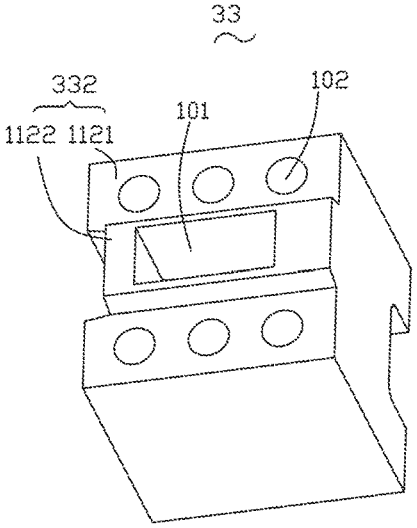
FIG. 12 illustrates isometric view of the other building block of the building system according to the third embodiment of the present disclosure, wherein such building block is designed as the connection block.
Figure 13:
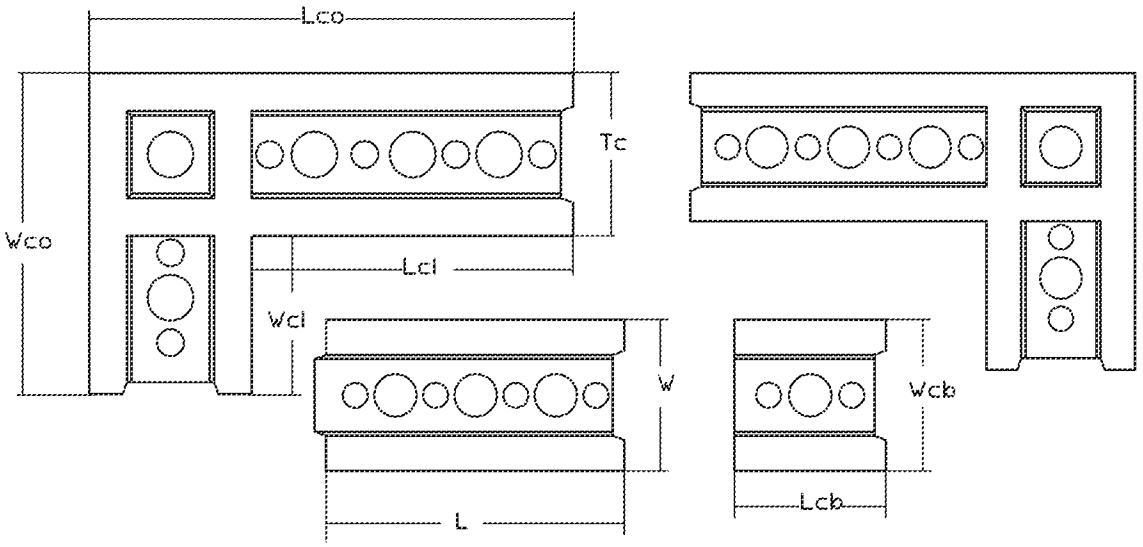
FIG. 13 illustrates dimensional relationships between the first block, the corner block and the connection block of the building system according to the first embodiment of the present disclosure.

Alternatively, as shown in FIGS. 11-13, according to a third embodiment of the present disclosure, the difference between the first embodiment and the third embodiment is that the second through hole may be disposed at a different position. The plurality of third through holes 102 may be disposed at the side of the projection 1122 and extending from the base face 1121 of the upper face 312 to the lower face 313 of the first block 31. The plurality of third through holes 102 can be divided into two groups disposed at both sides of the projection 1122, respectively. Each group has at least three adjacent third through holes 102.

Similarly, the corner block 32 also has the plurality of third through holes 102 disposed at the side of the projection 1122 and extending from the base face 1121 of the upper face 322 to the lower face of the corner block 32. The plurality of third through holes 102 can be divided into two groups disposed at both sides of the projection 1122, respectively. Each group has at least three adjacent third through holes 102.

Similarly, the connection block 33 also has the plurality of third through holes 102 disposed at the side of the projection 1122 and extending from the base face 1121 of the upper face 332 to the lower face 113 of the connection block 33. The plurality of third through holes 102 can be divided into two groups disposed at both sides of the projection 1122, respectively. Each group has at least three adjacent third through holes 102.

According to various embodiments of the present invention, when a first block and a second block similar to the first block 11 are mated adjacent to each other, the interlocking bond is formed. Precisely, when the tongue of the first block is mated with the concave portion of the second block, the interlocking bond is formed due to the complementary nature of the structure between the tongue and the concave portion. When the first block is stacked upon a second block, each of the first block and second block is at least one of the first block, corner block and connection block, an interlocking bond is formed by means of the projection 1122 interlocking with the groove 1131. Interlocking the plurality of blocks forms a network of horizontal and vertical channels with the first through holes 101 of the blocks aligned with each other in the vertical direction Z, and the horizontal through holes 14 of the blocks aligned with each other in the horizontal direction X,Y.

Figure 14:
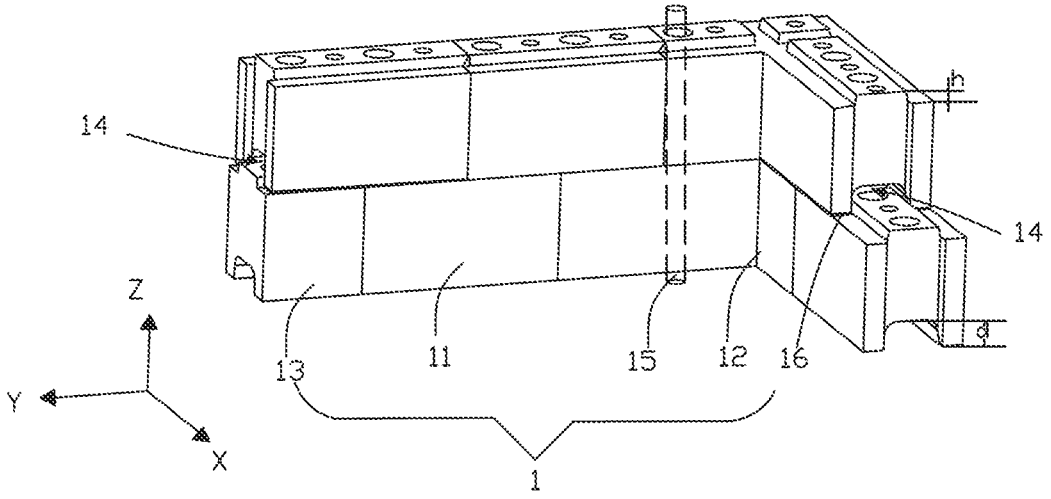
FIG. 14 shows the building blocks of the building system according to the first embodiment of the present disclosure interlocking with each other.

FIG. 14 shows the dimensional relation between the first block 11, the corner block 12, and the connection block 13. A width of the first block 11 is denoted by W, and a length of the first block 11 is denoted by L. An outer length of the corner block 12 is denoted by Lco, the dimension Lco is obtained by adding the length L of the first block 11 to the width W of the first block 11, i.e. Lco=L+W. An inner length of the corner block 12 is denoted by Lci, the dimension Lci is equal to the length L of the first block 11, i.e. Lci=L. An outer width of the corner block 12 is denoted by Wco, the dimension Wco is obtained by half of the length L of the first block 11 adding to the width W of the first block, i.e. Wco=½ L+W; An inner width of the corner block 12 is denoted by Wci, the dimension Wci is equal to half of the length L of the first block 11, i.e. Wci=½L. A thickness of the corner block 12 is denoted by Tc, the dimension Tc is equal to the width W of the first block 11, i.e. Tc=W. A length of the connection block 13 is denoted by Lcb, the dimension Lcb is equal to half of the length L of the first block 11, i.e. Lcb=½ L; A width of the connection block 13 is denoted by Wcb, the dimension Wcb is equal to the width W of the first block, i.e. Wcb=W. It should be understood that the dimension L and W of the first block 11 can be varied depending on the actual requirement of users. For instance, the dimension L may be 500 mm, and the dimension W may be 150 mm, thus, the dimension Lcb is 250 mm, and the dimension Wcb is 150 mm; the dimension Lco is 650 mm, the dimension Wco is 400 mm, the dimension Lci is 500 mm, and the dimension Wci is 250 mm. According to actual verification, this dimensional relation between the first block, the corner block and the connection block can guarantee that each building block can be perfectly construct a building without any need to cut them. It should be understood that a dimension allowance is existed while assembling the blocks for constructing the building, the value of the dimension allowance may be ranged from −30 mm to +30 mm, which is varied depending on the size of the gap between two adjacent blocks.

Figure 20:
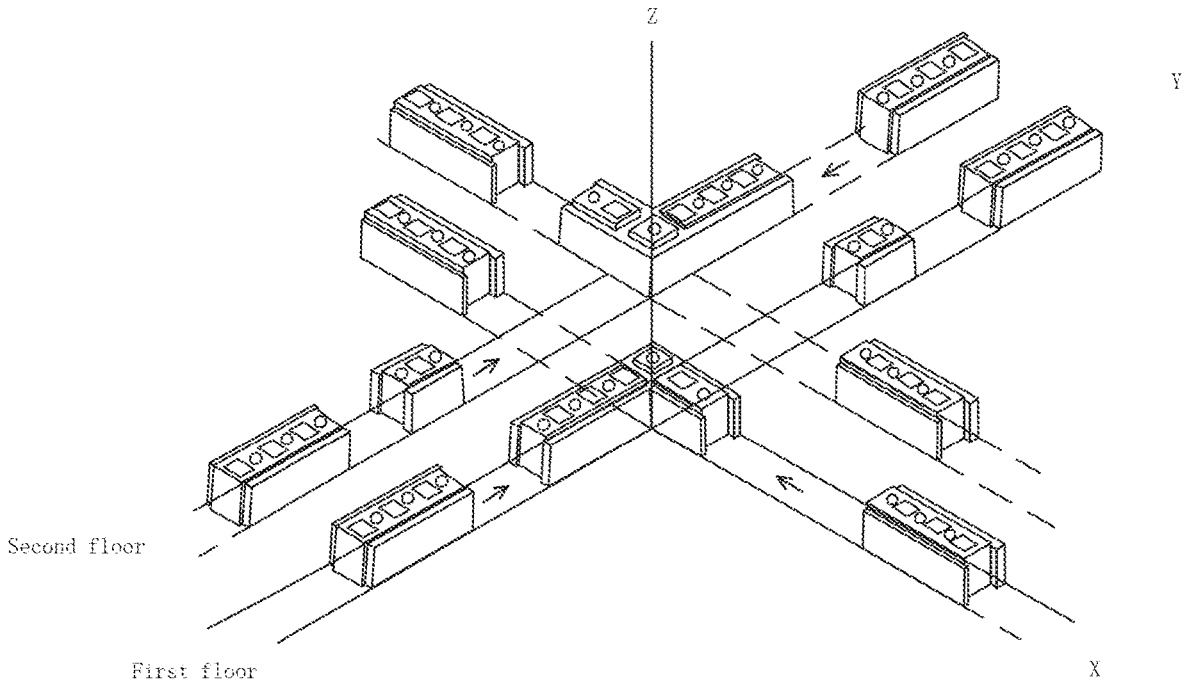
FIG. 20 shows a cross (namely,"+" shaped) building wall constructed by the first block, corner block, and the connection block according to the present disclosure.

As shown in FIG. 20, a cross (namely,"+" shaped) building wall is constructed by the first block 11, the connection block 13 and the corner block 12. At the first floor and second floor, the corner blocks 12 are arranged at completely different directions. Thus, the corner block 12 at the second floor is stacked upon the corner block 12 at the first floor, the corner of the corner block 12 is received in the two avoiding notches 1291, which can prevent the corner block from interfering with each other. When the cross building wall is constructed, the dimensional relations between the first block 11, the connection block 13 and the corner block 12 should satisfy above-mentioned conditions.

Figure 21:
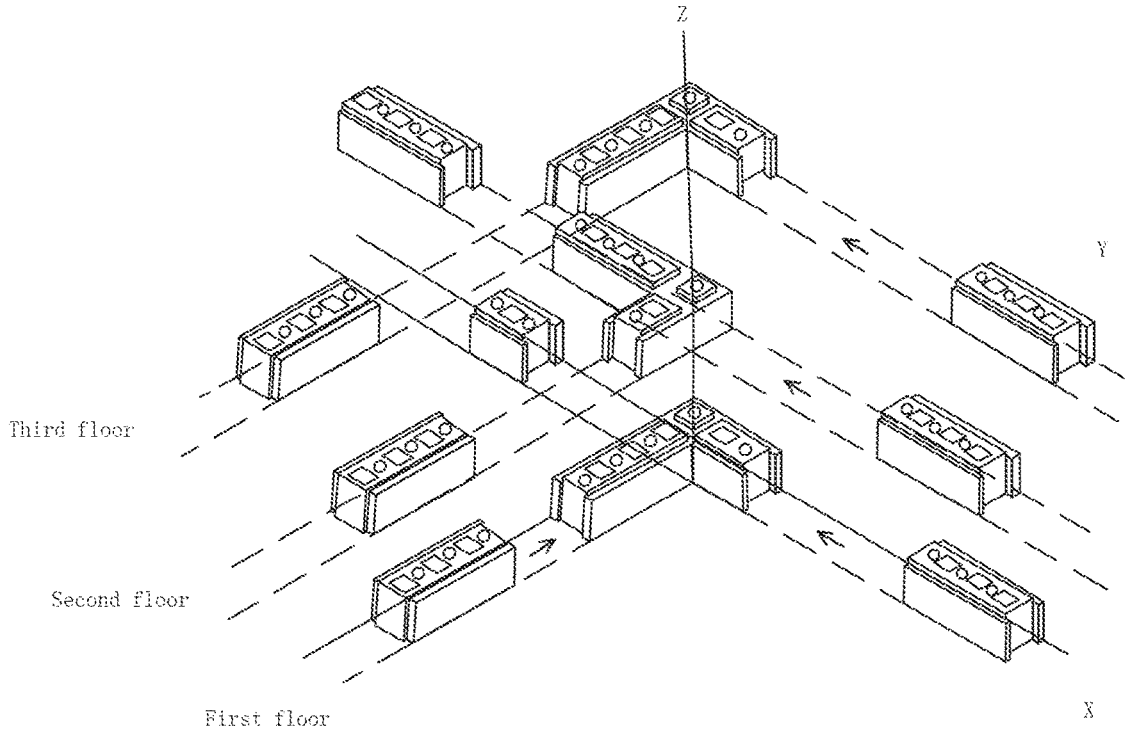
FIG. 21 shows a T-shaped building wall constructed by the first block, corner block and the connection block according to the present disclosure.

As shown in FIG. 21, a T-shaped building wall is constructed be the first block 11, the connection block 13 and the corner block 12. The corner block 12 at the second floor is stacked upon the corner block 12 at the first floor with a short side of the corner block 12 stacked upon a long side of another corner block 12. Thus, the corner block 12 at the second floor is received in one avoiding groove 1191, which can prevent the corner block from interfering with each other. When the T-shaped building wall is constructed, the dimensional relations between the first block 11, the connection block 13 and the corner block 12 should satisfy above-mentioned conditions.

FIG. 17 illustrates the building wall constructed using the first block 11, the connection block 13 and a plurality of reinforcing elements 15. When the building wall is constructed, at the first layer, a plurality of first blocks 11 are arranged horizontally side by side, and interlocking bonds are formed with the tongue interlocking with the concave portion of the first blocks 11. At the second layer, the first blocks 11 may be offset by half of the length L of the first block 11 relative to them at the first layer, and connection blocks 13 are filled to the termination ends. The connection blocks 13 and first blocks 11 are mated adjacent to each other, interlocking bonds are formed with the tongue mating with the concave portion. Interlocking bonds formed between the blocks 11,13 at the first layer and the second layer are formed with the projections 1122 of the blocks 11 at first layer mating with the grooves 1131 of the blocks 11,13 at the second layer. Thus, the third layer can be constructed the same as that at the first layer, and the fourth layer can be constructed the same as that at the second layer. With such configuration, the building blocks can be inter-engaged securely, which can resist an impact of strong objects and have good anti-seismic effect. The first through holes 101 at the first layer, the second layer and the third layer are aligned with each other to form a plurality of vertical channels for receiving the reinforcing elements 15.

Figure 19:
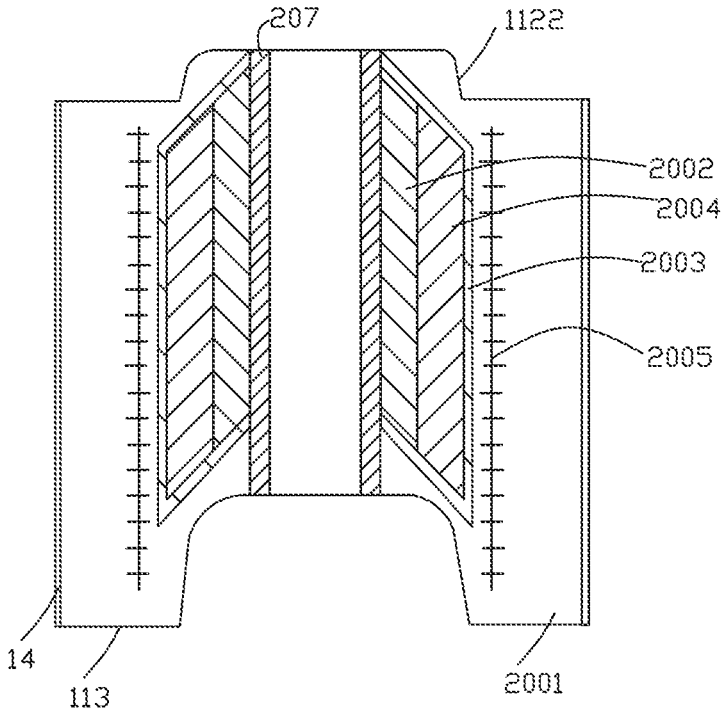
FIG. 19 is a cross sectional view, which schematically shows a structure of the first block, the corner block or the connection block according to the present disclosure.

Referring to FIG. 19, each of the first block, corner block and connection block includes a block body 2001, a core 2002 embedded into the block body 2001, and a waterproof layer 2003 between the block body 2001 and the core 2002, a thermal insulating layer 2004 between the waterproof layer 2003 and the core 2002, and a supporting member 2005 fixedly connected with the waterproof layer 2003, wherein the supporting member 2005 is embedded in the block body 2001. The waterproof layer 2003 can be a waterproof film and is configured to warp the core 2002; and the supporting member 2005 is configured for supporting the waterproof layer 2003. The supporting member 2005 can be a claw-shaped element made of metal, so as to support the waterproof layer 2003 in a large area, and a stretching rib is provided inside the supporting member 2005, so that the waterproof layer 2003 may flatly warp the outer peripheral surfaces of the core 2002 and the thermal insulating layer 2004 under the support of the supporting member 2005. In addition, the supporting member can be formed in mixing with the block body, so as to enhance the strength of the block. The thermal insulating layer 2004 is configured inside the waterproof layer 2003, to achieve a better thermal insulating effect. An internal sleeve penetrates through the block body 2001 and the core 2002 of the corner block 200, and a through hole is accordingly formed in the waterproof layer 2003, the waterproof layer 2003 extends inclined in a direction towards the block body 2001 from the through hole, so as to further enhance the waterproof effect. The thermal insulating layer 2004 is made of a thermal insulation material such as sponge. The core 2002 can be made of a thermal insulation material, or can also be made of a bulletproof material with relatively high strength, such as high-strength ceramic and the like. In addition, the core 2002 can be made of the same material as the block body 2001. Each of the first block, corner block and connection block further includes an internal sleeve 207 embedded in first through hole. The internal sleeve 207 may keep the inner face of the first through hole smooth, to facilitate the insertion or disassembly of the reinforcement element.

Figure 22:
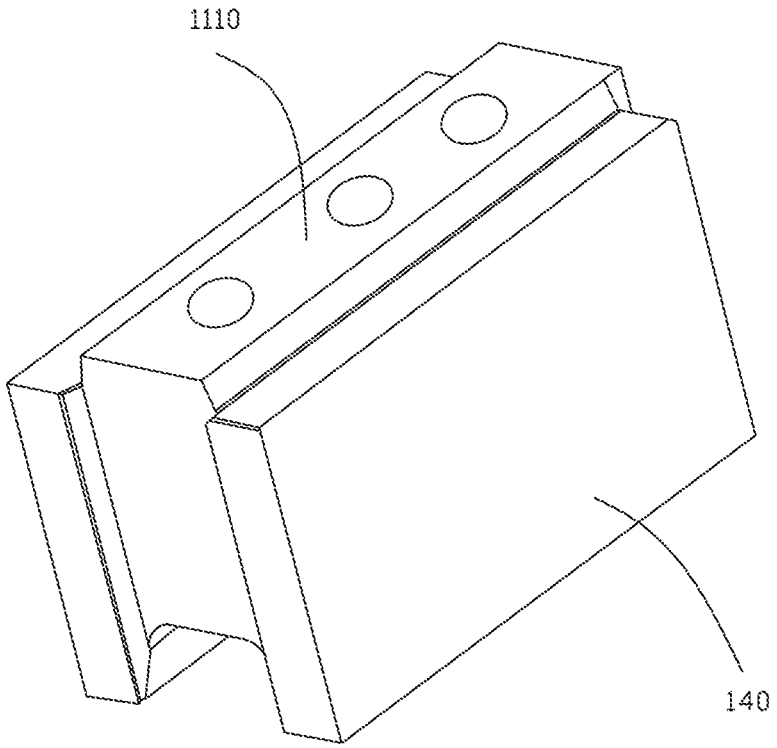
FIG. 22 shows the first block attached with a decorative member according to the present disclosure.
Figure 23:
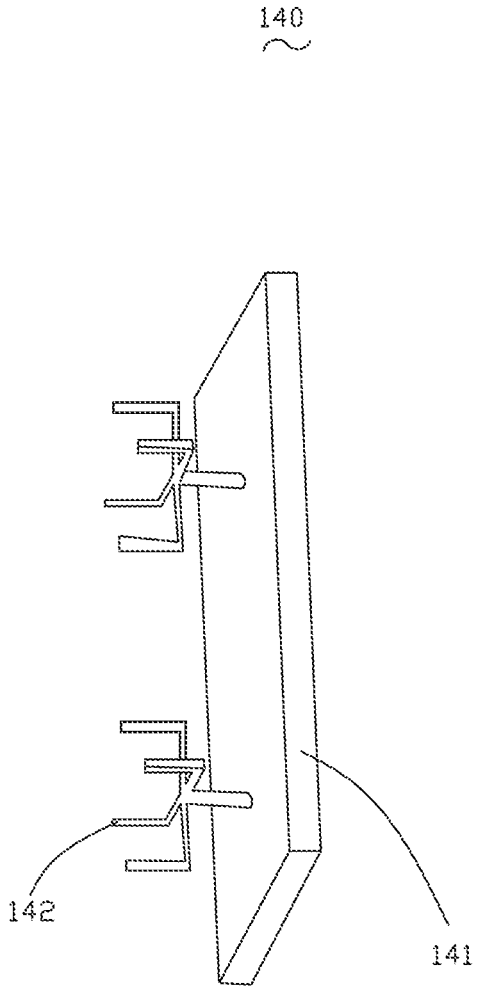
FIG. 23 is a schematic perspective view of the decorative member shown in FIG. 22.

Referring to FIG. 22 and FIG. 23, each of the first block, corner block and connection block includes a block body 1110 and a decorative member 140. The decorative member 140 is attached onto an outer surface of the block body 1110. Preferably, the decorative member 140 further includes a decorative plate 141 and an anchor 142 attached onto the decorative plate 141. When the block is shaped, the decorative member 140 is disposed in a mold, and then by pouring a flowing block body material into the mold, the flowing block body material will enclose the anchor. Therefore, the decorative member 140 and the block body 1110 are integrally formed as one piece.

Figure 18:
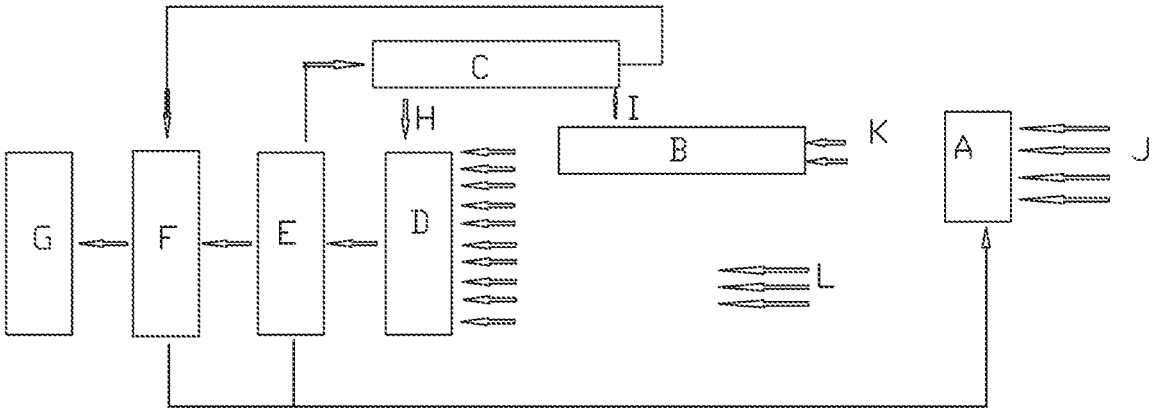
FIG. 18 is a flow chart for producing the building block of the present disclosure.

Referring to FIG. 18, a method for producing the building block according to present disclosure is disclosed. The method is described as following: a solid waste J including, but not limited to, industrial solid wastes, domestic wastes, construction wastes, urban sludge, and crop straw wastes, are recovered. Then, putting the recovered solid wastes J into a crushing center A to be pulverized into particles of about 5 mm. A high-water waste K (such as domestic garbage, municipal sludge, etc) is sent to a high-temperature dehydration and elimination center B for high-temperature dehydration, sterilization, and deodorization. A large amount of high-temperature steam I thus obtained would be transported to the high-temperature steam kiln C. Then, the pulverized solid waste L and the dehydrated waste are fed into a stirring center D together with a curing agent, a water repellent, a modifier, a flame retardant, and a binder in a certain ratio, and are thoroughly stirred and mixed. The mixed and stirred materials are sent to the product forming center E to make a building block billet. The billet is fed into the high temperature steam kiln C for high-temperature steaming, and the distilled water H thus produced is sent to the stirring center D for mixing and stirring. After high-temperature steaming, the billet is sent to a facing machining center F to be decorated according to the user's actual requirement and thus, a desired building block is produced. If necessary, the billet will be sealed with composite materials to ensure the physical and chemical properties of the billet stable for a long time. Finally, the building block is sent to the user after being sent to the palletizing packaging center G. However, in the palletizing packaging center G, the product with defect is sent to the product forming center E for repair, and the scrap is sent to the crushing center A for crushing and reused. There is no waste water, waste gas, and waste residue produced throughout the entire manufacturing process.

In the foregoing specification, specific embodiments of the invention have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of the invention. The invention is defined solely by the appended claims including any amendments made during the pendency of this application and all equivalents of those claims as issued.

What is claimed is:

1. A building system for constructing a building, comprising:

a first block, a corner block and a connection block interlocking with each other for constructing the building;

wherein, dimensional relations between the first block, the corner block and the connection block satisfies the following conditions:

$$Lco=L+W;$$

$$Wco=\tfrac{1}{2}L+W;$$

$$Lci=L;$$

$$Wci=\tfrac{1}{2}L;$$

$$Lcb=\tfrac{1}{2}L;$$

$$Wcb=W;$$

Wherein,

L is a length of the first block;

W is a width of the first block;

Lco is an outer length of the corner block;

Wco is an outer width of the corner block;

Lci is an inner length of the corner block;

Wci is an inner width of the corner block;

Lcb is a length of the connection block;

Wcb is a width of the connection block;

wherein, each of the first block, corner block and connection block includes a block body, a core embedded into the block body, and a waterproof layer disposed between the block body and the core, a thermal insulating layer disposed between the waterproof layer and the core, and a supporting member fixedly connected with the waterproof layer, wherein the supporting member is embedded in the block body.

2. The building system according to claim 1, wherein, each of the first block, the corner block and the connection block comprises a plurality of first through holes penetrating through each of the first block, the corner block and the connection block;

the building system further comprises a plurality of reinforcing elements, each of the reinforcing elements insert into the first through hole; and a plurality of connectors, two adjacent reinforcing elements located at the first through hole are connected together by one of the connectors.

3. The building system according to claim 2, wherein, each of the first block, the corner block and the connection block comprises:

an upper face, having a base face, and a projection protruding upward from the base face, a lower face, having a complementary groove located at the lower face for interlocking with the projection of a cooperating interlocking block when each block is stacked upon another block;

the first through holes formed in the projection and extending from the top face of the projection to the lower face.

4. The building system according to claim 3, further comprising a plurality of sealing gaskets, each of the sealing gaskets disposed on the base face of the upper face, sandwiched between two interlocking blocks which are stacked upon each other.

5. The building system according to claim 3, wherein, the corner block comprising an avoiding space disposed in a corner thereof; the avoiding space of the corner block is a recess formed on the projection at the corner for receiving the lower face of a cooperating corner block when corner blocks stacked upon each other.

6. The building system according to claim 5, wherein, the avoiding space comprises two avoiding notches, and a protruding portion disposed between the two avoiding notches and protruding upward.

7. The building system according to claim 3, wherein, a height of the projection in a vertical direction is smaller than a depth of the groove in the vertical direction so that a horizontal through hole is formed by means of the projection of each of the first block, the corner block and the connection block interlocking with the groove of the cooperating interengaging block while one block is stacked upon another block.

8. The building system according to claim 1, wherein, each of the first block, the corner block and the connection block comprises a block body and a decorative member attached onto the block body, the decorative member comprising a decorative plate and an anchor extending from the decorative plate into the block body.

9. A building system for constructing a building, comprising:

a first block;

a corner block;

a connection block;

each of the first block, the corner block and the connection block comprises a plurality of first through holes penetrating through each of the first block, the corner block and the connection block; the first block, the corner block and the connection block interlocking with each other so that the first through hole communicates with a corresponding first through hole in a vertical direction;

a plurality of reinforcing elements, each of the reinforcing elements insert into the communicated first through holes in the vertical direction;

each of the first block, corner block and connection block includes a block body, a core embedded into the block body, and a waterproof layer disposed between the block body and the core, a thermal insulating layer disposed between the waterproof layer and the core, and a supporting member fixedly connected with the waterproof layer, wherein the supporting member is embedded in the block body.

10. The building system according to claim 9, wherein, each of the first block, the corner block and the connection block comprises:

an upper face, having a base face, and a projection protruding upward from the base face, a lower face, having a complementary groove located at the lower face for interlocking with the projection of a cooperating interlocking block when each block is stacked upon another block;

the first through holes formed in the projection and extending from the top face of the projection to the lower face.

11. The building system according to claim 10, further comprising a plurality of sealing gaskets, each of the sealing gaskets disposed on the base face of the upper face, sandwiched between two interlocking blocks which are stacked upon each other.

12. The building system according to claim 10, wherein, the corner block comprising an avoiding space disposed in a corner thereof; the avoiding space of the corner block is a recess formed on the projection at the corner for receiving the lower face of a cooperating corner block when corner blocks stacked upon each other.

13. The building system according to claim 12, wherein, the avoiding space comprises two avoiding notches, and a protruding portion disposed between the two avoiding notches and protruding upward.

14. The building system according to claim 10, wherein, a height of the projection in a vertical direction is smaller than a depth of the groove in the vertical direction so that a horizontal through hole is formed by means of the projection of each of the first block, the corner block and the connection block interlocking with the groove of the cooperating interengaging block while one block is stacked upon another block.

15. The building system according to claim 9, wherein, each of the first block, the corner block and the connection block comprises a block body and a decorative member attached onto the block body, the decorative member comprising a decorative plate and an anchor extending from the decorative plate into the block body.

* * * * *